US005184424A

United States Patent [19]

Miller

[11] Patent Number: 5,184,424

[45] Date of Patent: Feb. 9, 1993

[54] SELF CORRECTING BELT TRACKING APPARATUS FOR WIDEBELT ABRASIVE GRINDING MACHINE

[76] Inventor: Todd L. Miller, 1110 E. Quilcene Rd., Quilcene, Wash. 98376

[21] Appl. No.: 781,119

[22] Filed: Oct. 22, 1991

[51] Int. Cl.[5] ..... B24B 21/12; B24B 21/20

[52] U.S. Cl. ..... 51/135 BT; 51/138; 51/357; 474/102; 474/106

[58] Field of Search ..... 51/135 R, 135 BT, 138, 51/148, 357; 474/101, 102, 106

[56] References Cited

U.S. PATENT DOCUMENTS

| | | | |
|---|---|---|---|
| 2,797,794 | 7/1957 | Bradley | 474/106 |
| 2,813,382 | 11/1957 | Pendergast | 51/135 BT |
| 3,504,458 | 4/1970 | Rutt | 51/135 BT |
| 3,592,071 | 7/1971 | Steinke | 474/106 |
| 3,702,131 | 11/1972 | Stokes et al. | 198/202 |
| 3,777,442 | 12/1973 | Bernu | 51/135 R |
| 3,900,973 | 8/1975 | Van der Linden | 51/135 BT |
| 3,971,166 | 7/1976 | Habeck et al. | 51/135 BT |
| 4,170,175 | 10/1979 | Conlon | 101/1 |
| 4,177,609 | 12/1979 | Rameckers et al. | 51/170 EB |
| 4,369,601 | 1/1983 | Gerber | 51/135 BT |

FOREIGN PATENT DOCUMENTS

| | | | |
|---|---|---|---|
| 484097 | 6/1952 | Canada | 474/106 |

*Primary Examiner*—Bruce M. Kisliuk
*Assistant Examiner*—Bryan Reichenbach

[57] ABSTRACT

An apparatus for controlling the lateral tracking movement of a wide abrasive belt that utilizes a driven contact roller and an idler roller that is mounted in a cradle that allows it to pivot about an axis perpendicular to the rotational axis of the idler roller and the non-abrasive back of the belt itself as it rides on an angled sensor. This sensor is angled such that the belt path becomes longer as the belt creeps and since the belt is unable to stretch it applys a force to the angled sensor which responds by increasing that force with a lever arm and continually adjusting the tracking mechanism through a connection to the pivoting cradle. These adjustments result in correct belt tracking.

5 Claims, 3 Drawing Sheets

SELF CORRECTING BELT TRACKING APPARATUS FOR WIDEBELT ABRASIVE GRINDING MACHINE

BACKGROUND—FIELD OF THE INVENTION

The invention relates to endless belt tracking control for abrasive grinding machines.

BACKGROUND—DESCRIPTION OF THE PRIOR ART

This invention relates generally to widebelt sanding or abrading machines wherein an endless abrading belt is driven around at least two spaced rollers one of which is driven and the other a belt tensioning idler which is movable toward and from the driven roller. This idler is also steerable to keep the belt tracking properly within the machines design parameters when subjected to the variable forces the belt is subjected to in a sanding machine. Typically the tracking mechanism consists of the idler roller that is mounted in a cradle so it can rotate about its own longitudinal axis and also swing back and forth about a pivot axis that is perpendicular to the rotational axis. It is this pivoting or skewing that steers the belt laterally depending on the direction and degree of skew.

In the past belt tracking has relied on expensive and complex mechanisms the are themselves prone to malfunction. Typical examples are U.S. Pat. No. 4,369,601 to D. J. Gerber, 1983 which utilizes electric eye beam sensors and patent U.S. Pat. No. 3,971,166 to G. E. Habeck, et al, 1976 which utilizes pneumatic pressure sensors to determine the belt edge location. These sensors commonly activate pneumatic cylinders or electronic solonoids which steer the idler roller back and forth which oscillates the belt back and forth between sensors.

These common approaches both have serious drawbacks. Electric eye beam sensors are prone to fail in the dusty environment of a sanding machine when dust obscures the optical sensing device. Pneumatic sensing systems are somewhat more reliable but require an outside sorce of pressurized air and will fail catastrophically if that source is interrupted. Because of these inherent reliablity problems caused by the reliance on such complex components current manufacturers that use such systems recognize the difficulties and equip the machines with emergency braking systems to quickly stop the machine when the belt mistracks, further complicating already complex and expensive systems, Also the side to side oscillation of the sanding belt causes problems, itself. While this movement is not enough to spread the wear across the belt to any effective degree it does mean the abrasive cutting action is always traveling slightly diagonal to the direction the work is traveling resulting in zig zag scatches down the length of the workpiece.

Simpler systems for the training of endless belts that utilize the belt edge itself to adjust the tracking mechanism, U.S. Pat. No. 4,177,609 to S. J. Rameckers, et al, 1979 and U.S. Pat. No. 3,702,131 to D. R. Stokes, et al, 1972, being typical examples, are useless because of the high speeds an abrading belt travels at as well as the abrasive nature of the belt will quickly destroy any edge sensing device.

U.S. Pat. No. 4,170,175, B. F. Conlin, 1979 shows a method for tracking a low speed belt using the back side of the belt that requires the use of at least three rollers that are the full width of the endless belt. This addition of at least a third full length roller for belt edge sensing adds considerable cost, size and complexity to a widebelt abrasive grinding machine. And since there is not method to increase the force to a degree necessary to overcome the considerable lateral force caused by the belt creep during an abrasive grinding operation it is unlikely such a system would work for such a machine.

Therefore the need for a simple, compact, reliable and inexpensive belt training mechanism is obvious and this invention fulfills that need.

OBJECTS AND ADVANTAGES

Accordingly several objects and advantages of may invention are to provide an improved simple, reliable and inexpensive system to keep an endless belt correctly trained on a wide belt abrasive sanding or grinding machine. Specifically with a belt edge sensing device that utilizes the non-abrasive back side of the belt to determine the belt edge and using forces caused by the creeping of said belt itself, and increases such force as necessary by the mechanical advantage provided by a lever and direct said force for the purpose of adjusting the tracking mechanism in the correct manner to overcome this belt creeping.

Further objectives are to accomplish this belt tracking without the use of auxiliary pneumatic or electronic sensing devices or actuators and therefore provide a compact and efficient assembly that can be relied upon to be long lived in the extremely dusty conditions of an abrading machine.

Another specific object is to accomplish this belt tracking without the use of an additional roller that is the full width of the endless belt.

Another specific objective is to provide a means to adjust said sensing and tracking device to center the endless belt in the machine to to compensate for variations in individual belts when said belts are changed routinely in the course of using the machine.

Another specific objective is to accomplish the belt tracking without oscillating the belt from side to side thus utilizing the entire width of the belt as well as resulting in an improved surface finish on the workpiece.

With these observations and objectives in mind, the manner with which the invention achieves these objectives will become apparent during the course of the following detailed description with references to the accompanying drawings. This decription and drawings illustrate one complete embodiment of the invention constructed according to the best mode so far devised for the practical applications of the principles thereof and it should be understood that changes may be made in the specific apparatus without departing from the essentials of the invention.

DETAILED DESCRIPTION OF THE INVENTION

Figure 1:
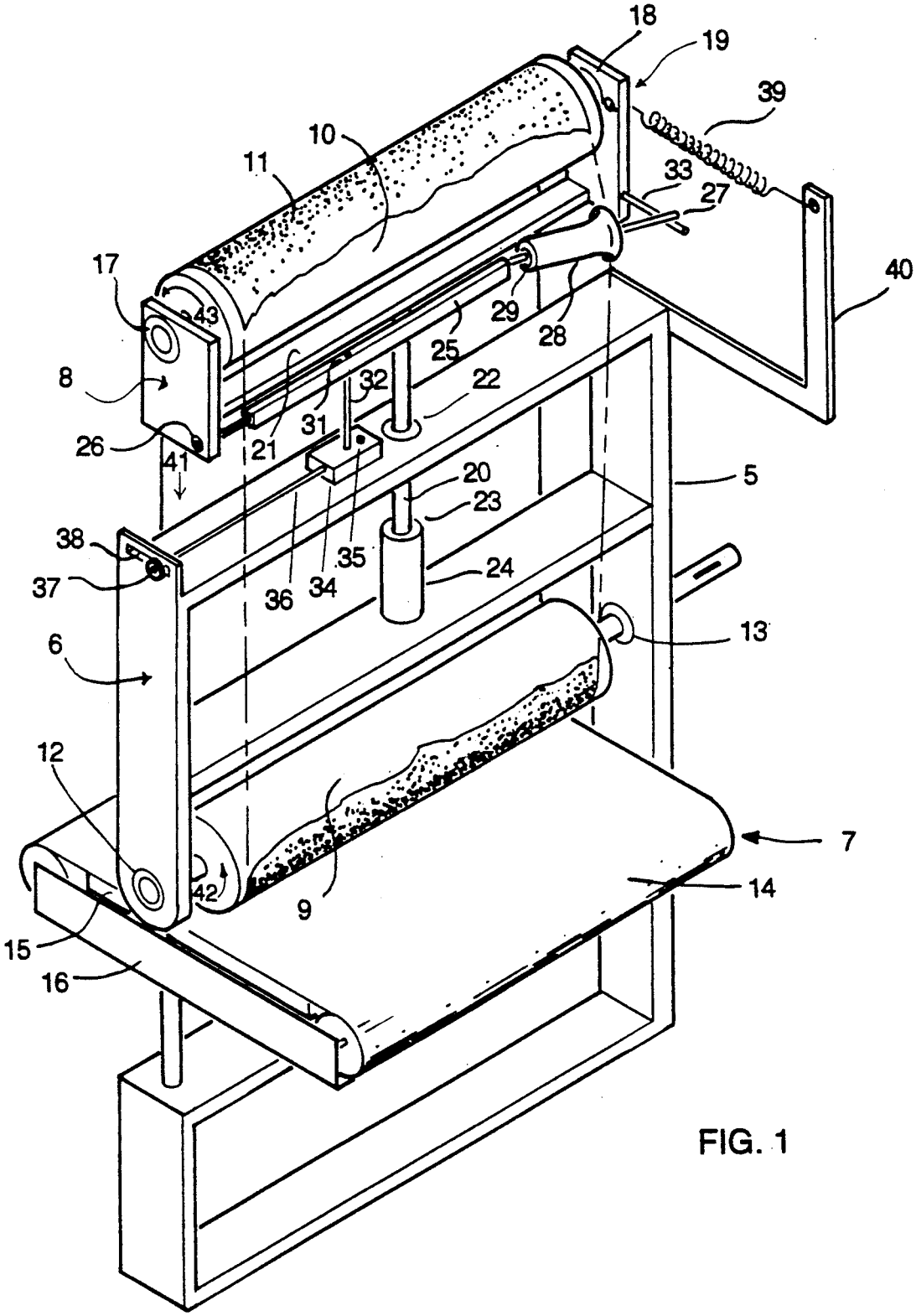
FIG. 1 is a perspective view of a wide belt sanding machine utilizing this invention.

Referring to the accompanying drawings the numeral 5 designates generally the main frame of the machine which is of rigid construction upon which abrading head 6 is extended in cantilever fashion over work feeding mechanism 7. Abrading head 6 consists of an endless abrasive belt 11 trained over contact roller 9 and idler roller 10 and belt edge sensing device 28. Contact roller 9 is journaled in bearings 12 and 13 for rotation around a fixed axis and powered by a conventional means not shown. Work feeding mechanism 7 consists of an endless conveyor belt 14 carried over platen 15 which is held by frame 16 which is vertically adjustable by a means not shown to carry workpieces of varying thickness through the machine under the contact roller. Idler and belt tracking assembly 8 is made up of idler roller 10 which is journaled in bearings 17 and 18 in cradle 19 for rotation about a fixed axis. Cradle 19 further consists of pivot shaft 20 which projects downward from a midpoint of beam 21 in perpendicular relation to the rotational axis of idler roller 10. Pivot shaft 20 is carried by bearings 22 and 23 permitting cradle 19 to swing back and forth in a horizontal plane.

Raising and tensioning mechanism 24 raises and lowers idler and belt tracking assembly 8 and may be mechanical, pneumatic, hydraulic or any other means to properly raise and tension said assembly and belt.

Assembly 8 further consists of lever arm 25 of which one end is machined round and passes through anti-friction bushing 26 and is allowed to slide through said bushing. On the opposite end of lever 25 and attached at an obtuse angle which is in this particular embodiment is approximately 10 degrees, in the horizontal plane is axle 27 upon which rides edge sensing roller 28 which rotates in bearings 29 and 30.

Figure 3:
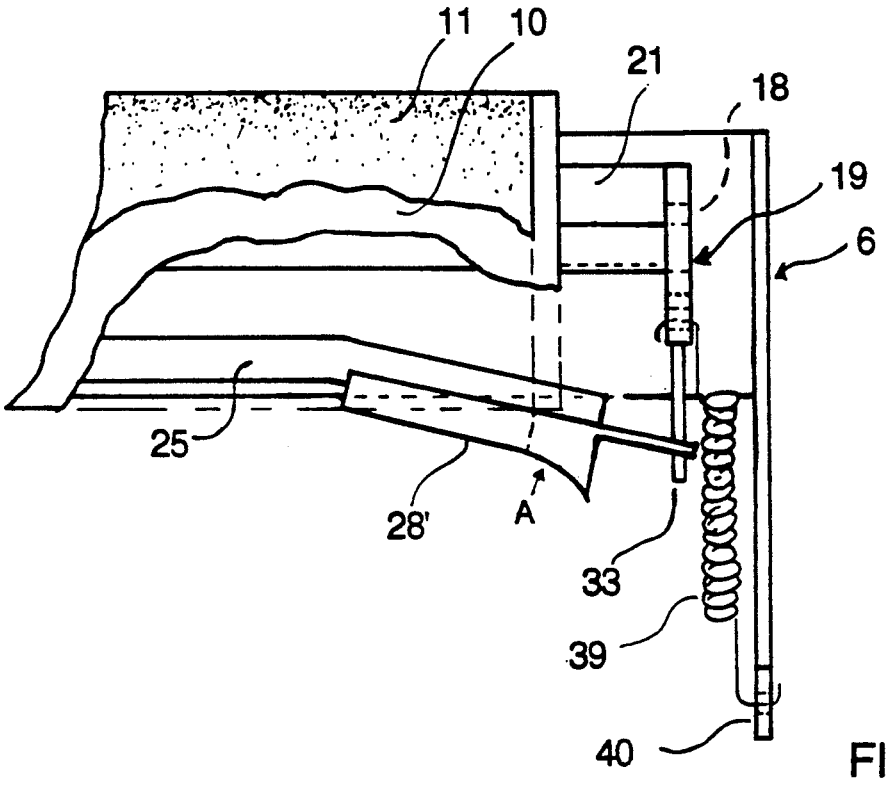
FIG. 3 is a partial top view, portions of which are broken away, of an alternative embodiment of edge sensing device 28'.

In place of such a roller, a curved platen block 28' coated with an antifriction material such as graphite could be substituted and mounted on the end of lever 25 at the same approximate angle. FIG. 3 represents such an edge sensing device. In either case the beginning of the arc marked by a point A corresponds to the plane of the end of idler roller 10 and flaring outwardly to its greatest diameter away from the normal position of the belt 11.

Located along lever 25 approximately two thirds of the distance from the belt sensing device 28 or 28' to the opposite end is pivot bearing 31 which allows said lever to rotate around pivot 32 as well as slide along a vertical axis up or down. The end of the axle 27 of roller 28 or alternately the end of platen 28' is carried on support 33 to assist said vertical movement at the same time allowing said end to slide freely horizontally.

Pivot 32 is carried by pivot block 34 and which is adjustable around a radius centered at pivot bolt 35 which is located in a threaded hole in main frame 5. The location of pivot 32 is changed when handle 36 is moved horizontally. When knob 37 is tightened on a threaded portion of said handle against slot 38, the location of pivot 32 becomes fixed.

Helical tension spring 39 pulls idler and belt tracking assembly 8 toward bracket 40 which is affixed to the main frame.

Operation of the Invention

Figure 2:
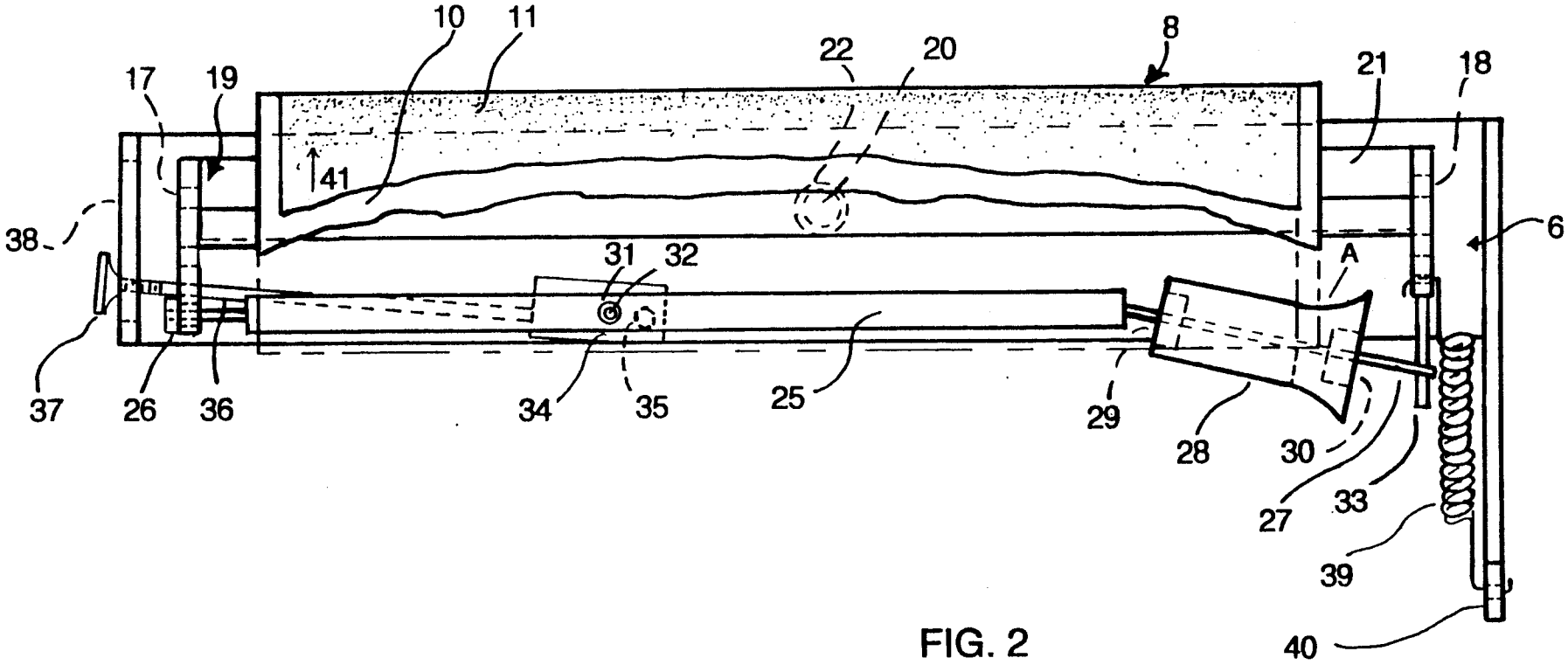
FIG. 2 is an enlarged partial top view of the preferred embodiment of said machine, portions of which are broken away, to horizontal plane 2.

Referring to the preferred embodiment depicted in FIGS. 1-3 the operation of the invention is as follows. Referring to FIG. 1, Abrasive belt 11 is trained around contact roller 9 and idler roller 10 and belt edge sensing roller 28. Abrasive belt 11 is centered on idler roller 10 and properly tensioned by mechanism 24 and is traveling in the direction of arrows 41, 42 and 43. Referring to FIG. 2, Spring 39 constantly pulls idle and belt tracking assembly 8 in a clockwise direction. This skewing will cause belt 11 to creep to the right with the back of the belt riding along the angled portion of edge sensing roller 28 or referring to FIG. 3 the belt will travel to the right on curved sensing platen 28'. As it travels further to the right the belt path becomes longer and because the belt is unable to stretch it correspondingly will increase the tension applied to said edge sensing device thereby forcing lever 25 in a counterclockwise direction. As the long leg of lever 25 is approximately two times as long as the short leg a mechanical advantage is gained magnifying the relatively small force applied to the lever by the increasing belt tension until it is large enough to overcome the at times considerable creeping force and through the connection to cradle 19 at bushing 26 rotate said cradle in a counterclockwise direction causing belt 11 to move to the left. In practice the belt will find a point of equilibrium between these forces and continually correct any belt wandering. Should the belt creep to the right so far as to run off the edge of idler roller 10 which will result in a decrease in tension at the edge of said belt the increasing flare of the edge sensing device will compensate for that decrease.

As each abrasive belt is somewhat different it will find a different tracking path when trained between idler roller 10 and contact roller 9 along the length of said rollers when the tracking system is in equilibrium. By adjusting the position of pivot 32 slightly the belt tracking mechanism can easily be made to keep the belt trained in the center of the rollers for the most effective operation of the machine. Pivot 32 is adjusted by moving handle 36 along the length of slot 38 while the machine is in operation until the belt tracks in the optimum position at which point knob 37 is tightened to lock the pivot against accidental movement.

SUMMARY, RAMIFICATIONS AND SCOPE OF INVENTION

Thus the reader will see that the belt tracking system of this invention is of a very simple, inexpensive and reliable nature and as a result is an important improvement upon the prior art. While my above description contains many specificities, these should not be construed as limitations on the scope of the invention, but rather as an example of one preferred embodiment therof. For example the belt tracking system could be used for web control in printing equipment, conveyor belt tracking etc.

Thus the scope of the invention should be determined by the appended claims and their legal equivalents rather than by the examples given.

What I claim is:

1. A system for driving an endless belt along a predetermined path, that consists of at least two spaced rotating rollers the full width of said endless belt over which said belt is trained, a means for driving one of said rollers and a tracking means for said endless belt, mounted on a suitable frame means, said tracking means consists of a steerable cradle means for carrying one of the rollers for pivotal rotation around an axis perpendicular to the roller's rotational axis, said pivotable rotation is accomplished in one direction by a force means and in the other direction by a belt position lever means that pivots on a shaft mounted on said frame means, said shaft axis is at a substantial right angle to the rotational axis of one of said rollers and substantially parallel to the plane containing the rotational axis of both of said rollers, said lever movement is contained within a plane of motion that is substantially orthagonal to the plane that contains the axis of said rollers, one end of said lever means is attached to said cradle, the other end is engagable with an area of the back surface of one edge of said belt so as said lever means protrudes out of the belt flight plane that said belt describes while traveling between said rollers and said lever is reponsive to pressure from said belt as said belt travels a longer flight path on said edge to overcome the force from said force means.

2. A system defined in claim 1 wherein said belt position lever means incorporates a roller that is straight along most of its length and flared in a curve of increasing diameter on the end that engages the back surface area of said endless belt.

3. A system defined in claim 1 wherein said belt position lever means incorporates a platen with an anti-friction coating whose shape is straight along most of its length and curves outward at the end and is attached to the end of said lever means that engages the back surface area of said endless belt.

4. A system defined in claim 1 wherein said belt position lever means has an adjustable pivot point in such a manner as to allow said belt position lever means to engage the back surface area of one edge of said endless belt at different places.

5. An abrasive grinding machine consisting of an abrasive head that utilizes a system for driving an endless abrasive belt along a predetermined path, said abrasive head consisting of at least two spaced rotating rollers the full width of said endless belt over which the belt is trained, a means for driving one of said rollers and a tracking means for said endless belt, mounted on a suitable frame means, said tracking means consists of a steerable cradle means for carrying one of the rollers for pivotal rotation around an axis perpendicular to the rollers rotational axis, said pivotable rotation is accomplished in one direction by a force means attached to said frame means and in the other direction by a belt position lever means that pivots on a shaft mounted on said frame means, whose axis is at a substantial right angle to the axis of one of said rollers and substantially parallel to the plane containing the rotational axis of both of said rollers, said lever movement is contained within a plane of motion that is substantially orthagonal to the plane that contains the axis of said rollers, one end of said lever means is attached to said cradle, the other end is engagable with an area of the back surface of one edge of said belt so as said lever means protrudes out of the belt flight plane that said belt describes while traveling between said rollers and said lever means is reponsive to pressure from said belt as said belt travels a longer flight path on said edge to overcome the force from said force means, said abrasive head is used with a workfeeding means that is adjustable with relation to said abrading head to accomodate varying sized workpieces.

* * * * *